United States Patent [19]

Szikla

[11] 4,016,810

[45] Apr. 12, 1977

[54] JEWELRY IMPRINTING DEVICE

[76] Inventor: Leslie Szikla, 63-34 Saunders St., Rego Park, N.Y. 11374

[22] Filed: Mar. 19, 1975

[21] Appl. No.: 559,662

Related U.S. Application Data

[63] Continuation-in-part of Ser. No. 487,166, July 10, 1974, abandoned, which is a continuation of Ser. No. 272,342, July 17, 1972, abandoned.

[52] U.S. Cl. ..... 101/4; 101/26; 101/99

[51] Int. Cl.[2] ..... B44B 5/00

[58] Field of Search ..... 101/269, 376, 379, 99, 101/4, 153, 26

[56] References Cited

UNITED STATES PATENTS

| | | | |
|---|---|---|---|
| 1,096,084 | 5/1914 | West | 101/4 |
| 1,746,516 | 2/1930 | Boyer | 101/99 |
| 2,105,660 | 1/1938 | Kirshner | 101/99 X |
| 2,114,379 | 4/1938 | Hamant | 101/153 |
| 2,686,468 | 8/1954 | Bliss | 101/99 X |
| 2,813,269 | 11/1957 | Jacobs | 101/26 X |
| 2,896,530 | 7/1959 | Bernhard | 101/4 |
| 3,650,209 | 3/1972 | Allport | 101/269 |

*Primary Examiner*—Clyde I. Coughenour
*Attorney, Agent, or Firm*—Bierman & Bierman

[57] ABSTRACT

A tool for stamping symbols on a piece of jewelry is provided having a pliers-type mechanism with two jaws between which the jewelry is placed. One or more rotatable marking wheels in the shape of a gear is placed on the interior of one of the jaws. Each of the marking wheels has a symbol engraved on at least one of its teeth such that when the handle portion of the pliers is squeezed, a symbol is stamped into the jewelry.

13 Claims, 8 Drawing Figures

FIG. 1
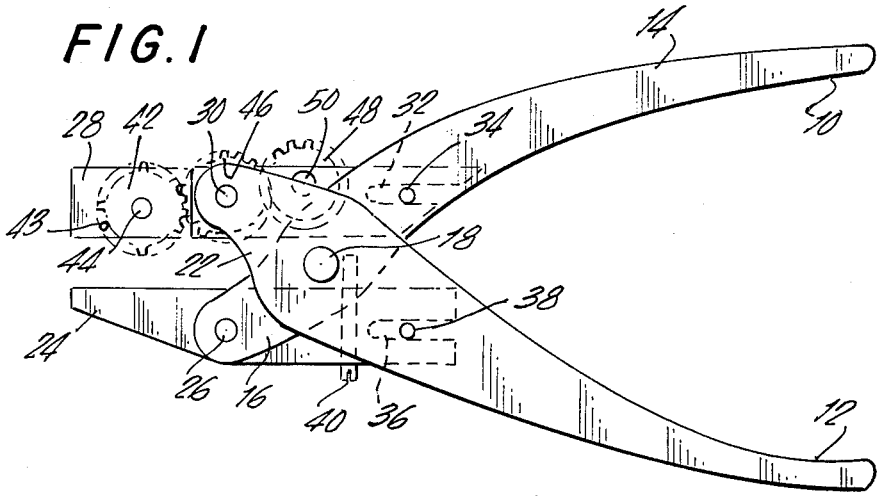
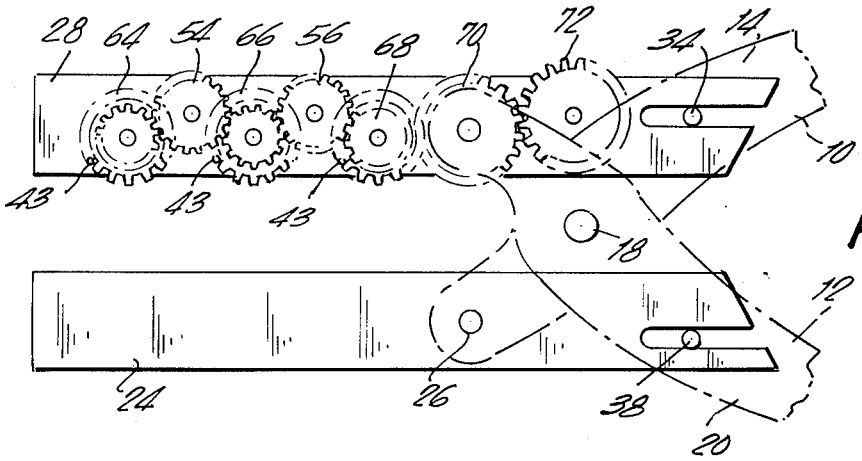
FIG. 2
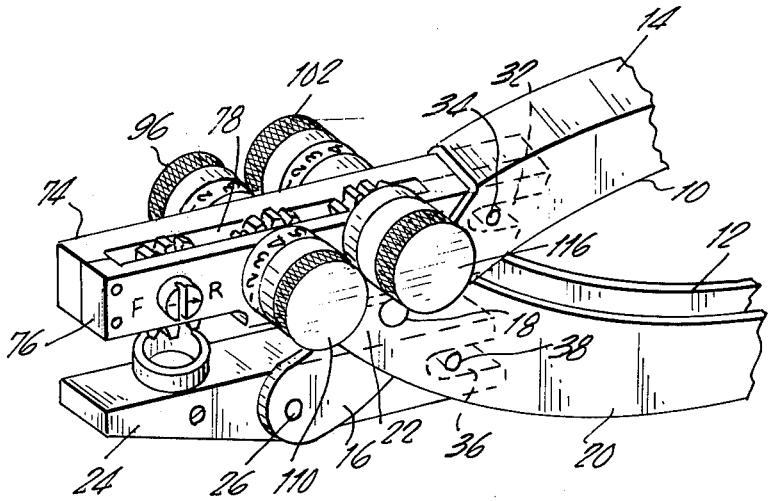
FIG. 3

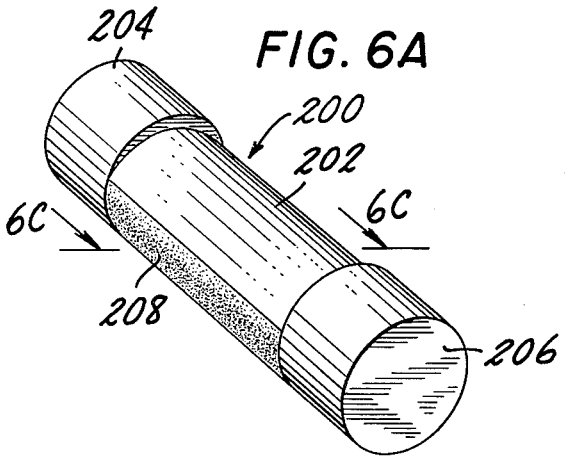
FIG. 6A
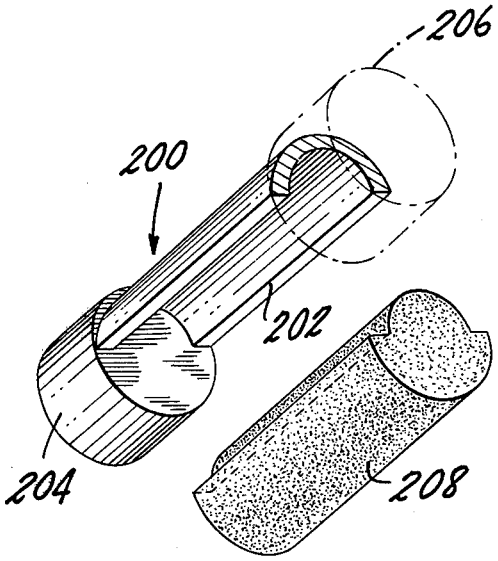
FIG. 6B
FIG. 6C
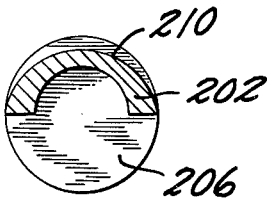

JEWELRY IMPRINTING DEVICE

This application is a continuation-in-part of Ser. No. 486,166, filed July 10, 1974, which is a continuation of application Ser. No. 272,342, filed July 17, 1972 both abandoned.

This invention relates to metal imprinting devices and more particularly to a device for stamping symbols on jewelry. This device is particularly useful in the jewelry industry to enable a retail store or a jewelry manufacturer to stamp numbers or letters into the inside of the shank of a ring. A jeweler may stamp the carat weight of the stone mounted on the ring or of the metal used in the ring, or if desired, the date of sale, reference number, his trademark, or lettering.

In accordance with the present invention, a pliers-like device is provided upon which a pair of jaws are mounted. One of the jaws acts as an anvil and the other is provided with one or more marking wheels which are in the general shape of a gear. Upon the face one or more of the teeth of the marking wheel is an engraved symbol. Means for rotating the marking wheel or wheels is provided so that the desired symbol may be selectively positioned for stamping.

In operation, a jeweler places an article, such as a ring, over the jaw containing the marking wheel and after selecting the desired symbol and positioning the marking wheel, he squeezes the handle portions of the pliers together, thus stamping one or more symbols onto the shank of the ring.

In one of its preferred forms, the jaw is provided with three wheels, each of which is in the shape of a gear. These wheels are rotatably mounted on the jaw and in communication with each other. One of the wheels is a marking wheel with symbols engraved on the face of its teeth. The other two wheels serve as means for rotating the marking wheel so that the appropriate symbol can be selectively positioned for stamping without removing the ring from the device.

A second preferred embodiment of the invention has a jaw upon which a series of marking wheels are rotatably mounted in tandem.

In this embodiment, all of the wheels rotate simultaneously and the jeweler must position the ring opposite the appropriate marking wheel for stamping the desired symbol. Only one wheel is utilized at any particular time.

Since each wheel has only a limited number of teeth, and therefore a limited number of symbols which it can stamp, the more wheels that are provided, the greater the variety of symbols available. A device having three marking wheels in tandem, therefore, has the capability of stamping three times as many different symbols as does a device equipped with a single wheel. This, of course, adds greatly to the versatility and usefulness of the device.

A third preferred embodiment of the present invention has a jaw provided with four marking wheels in a side by side relationship on a single axis. This configuration enables a jeweler to imprint a symbol having up to four digits in a single stamping operation. Each of these marking wheels is essentially like the ones previously described, having a gear like shape with symbols engraved on one or more of its teeth. Apparatus is provided for selectively positioning each of these wheels individually without changing the position of the other three wheels. This configuration gives the jeweler the greatest amount of versatility while affording substantial savings in time, as a single stamping operation can accomplish the work of several stamping operations with either of the previously described embodiments. In addition, generally one of the teeth on each of the marking wheels has no symbol engraved on it. This would enable the jeweler to leave a blank in any one of the four digits of the symbol should he desire to do so.

In the multiple digit printing operation described above, means are provided for adjusting the relationship between the marking wheels to fit the curvature of the inside of the shank of the ring. This is necessary to insure uniformity of depth of the stamped symbols. If no such means were provided, the marking wheels at either end of the series would make deeper impressions than the middle marking wheels, due to the curvature of the ring.

This embodiment has another advantage over the repeated use of the embodiments previously described. A jeweler separately stamping several symbols into the shank of a ring would have to exercise utmost care in positioning the symbols in order to insure proper alignment. The third embodiment of the invention eliminates this difficulty by providing a means for positioning the teeth selected for stamping in an even row. Therefore, once the wheels are appropriately positioned, the teeth are aligned and the stamp will have each of its individual digits in a straight line.

For best results, the mounting of the jaws on the pliers is accomplished in such a way so that the jaws are retained in a substantially parallel relationship with each other, regardless of the position of the pliers portion.

If desired, the jaw elements of any of the embodiments described herein can be used in conjunction with different devices other than the parallel pliers. Any type of mechanism can be utilized which will supply a force perpendicular to the plane in which the jaw containing the marking wheel lies. For instance, a foot press where the jaw element containing the marking wheel forms the bottom stationary die is suitable.

In addition, a bar slidably mounted parallel on one of the jaw elements and adjacent the portion of the jaw at which the ring will be positioned may be provided. This bar will assure the correct positioning of the ring with respect to the marking wheel. The slidable mounting will enable the jeweler to adjust the position of the bar in accordance with the size of the ring and will, therefore, insure optimum results for every stamping operation.

Now turning to the drawings depicting the several preferred embodiments of the present invention wherein like numerals refer to like parts.

FIG. 1 is a side cutaway view of the first embodiment of the invention.

FIG. 2 is a side cutaway view of the second embodiment of the invention having three marking wheels in tandem.

FIG. 3 is a perspective view of the third embodiment of the present invention.

FIG. 6A is a detail isometric view of a self-adjusting axle useful in the embodiment shown in FIG. 4.

FIG. 6B is an exploded sectional view of the self-adjusting axle of FIG. 6A.

FIG. 6C is a sectional view of the axle of FIG. 6 taken along line 6—6 in FIG. 6.

Figures 4, 5:
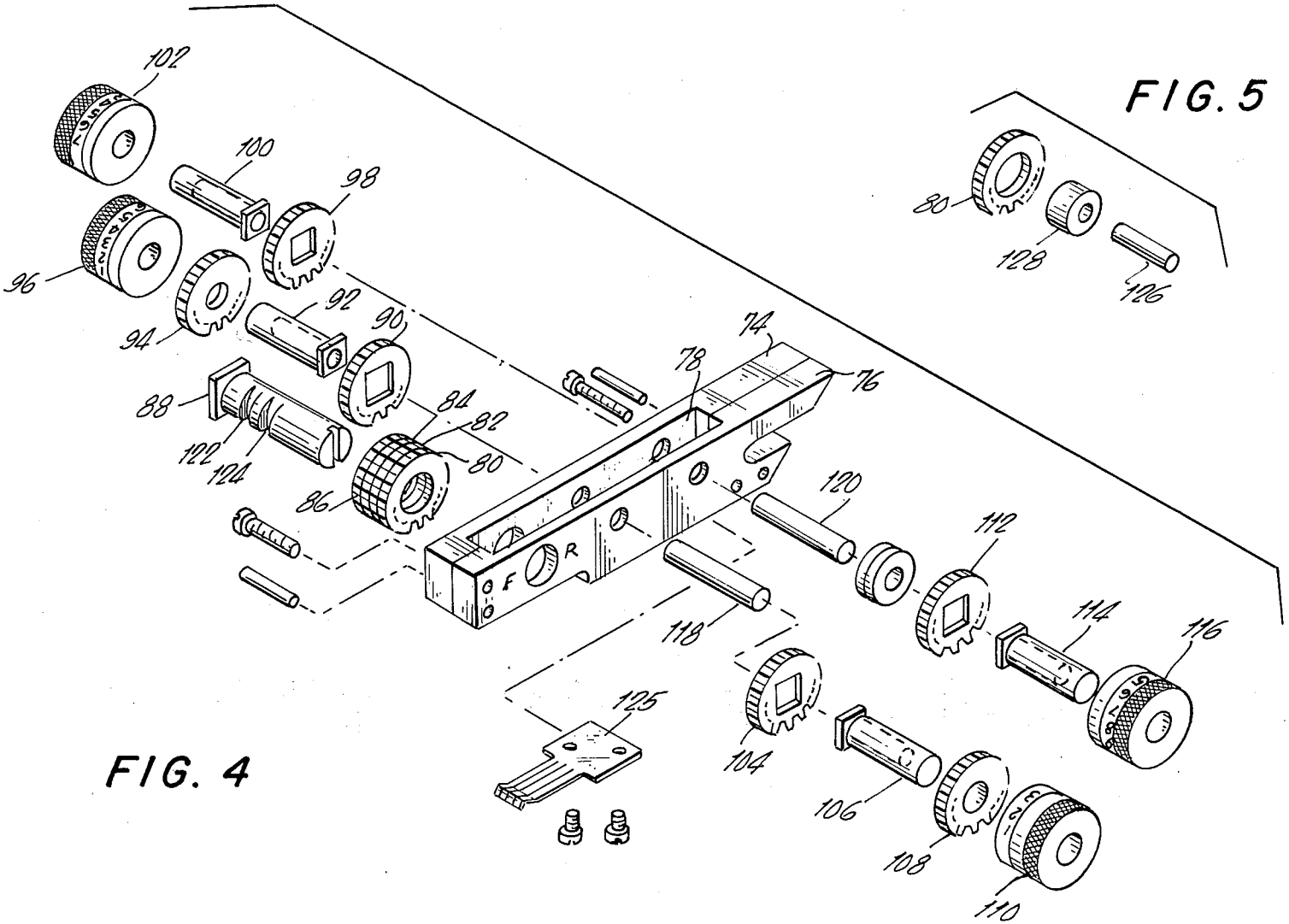
FIG. 4 is an exploded side view of the jaws portion of the third embodiment of the invention.
FIG. 5 is an exploded view of an axle made of deformable material for use in the third embodiment of the invention.

In FIG. 1 numerals 10 and 12 refer generally to the handle members respectively of the pliers-like portion of the device. Handle member 10 is divided into handle portion 14 and forward portion 16 by pin 18. Handle member 12 is likewise divided into handle portion 20 and forward portion 22 by pin 18. Pin 18 provides a pivot point for handle members 10 and 12. Jaw element 24 is pivotably connected to the forward portion 16 of handle member 10 by pin 26. Likewise, jaw portion 28 is pivotably connected to the forward portion 22 of handle member 12 by means of pin 30. In addition, a slot 32 is provided in the end of jaw 28 to enable slidable mounting to handle portion 14 by means of shaft 34. A similar slot 36 is provided in jaw element 24 for slidable mounting on handle portion 20 by means of shaft 38.

Handle members 10 and 12 are movable between a first position wherein handle portions 14 and 20 are spread apart and a second position wherein handle portions 14 and 20 are close together. The movement of the handle members 10 and 12 also moves jaw elements 24 and 28. When the handle members are in the first position, jaw elements 24 and 28 are spread apart. When handle elements 10 and 12 are moved to the second position, jaw elements 24 and 28 are moved into close proximity with each other. However, no matter what position the handle members are in, the jaw elements retain a substantially parallel relationship with each other due to the means of attachment to the handle portion. Although the parallel relationship of the jaws is of substantial importance for the uniform stamping of symbols, it can be dispensed with if so desired.

In addition, jaw 24 is provided with a threaded bore into which a screw 40 is positioned. Screw 40 limits the position of the jaw elements such that by proper adjustment of screw 40 the desired depth of stamping will always be attained no matter how hard one squeezes the handle portions together.

Marking wheel 42 is rotatably mounted upon jaw element 28 by means of pin 44. Marking wheel 42 is shaped like a gear and symbols are engraved on the face of each of its teeth. In addition, corresponding symbols are printed on the face of the gear to enable selective positioning of the wheel to obtain the desired symbol. An indicator marker is provided on the head of shaft 44 to point to the symbol which is in position for stamping.

The gears used are necessarily small. For best results, the tops of the teeth of the gear are cut down to provide a flat surface upon which raised indicia may be placed. It has been found that cutting back the tip of the teeth does not affect engagement of the marking wheel 42 with other gears, such as 46 (FIG. 1) which are used to rotate the marking wheel.

A cog wheel 46 is rotatably mounted on jaw element 28 by means of pin 30. Cog wheel 46 is also in the shape of a gear and is positioned so that its teeth mesh with the teeth of marking wheel 42. A thumb wheel 48 is rotatably mounted on jaw 28 by means of shaft 50. Thumb wheel 48 is also in the shape of a gear and is positioned so that its teeth mesh with the teeth of cog wheel 46.

A bearing ball 43 is spring loaded in an indent (not shown) adjacent to the outer periphery of marking wheel 42 to provide proper indexing and positioning for the wheel. This indexing feature assures that the surface of the gear tooth which is selected for imprinting will be substantially parallel to the interior surface of the ring.

In operation, the jeweler places the device in his hand so that he is able to squeeze handle portions 14 and 20 together when necessary. He extends his thumb adjacent to thumb wheel 48 and rotates the thumb wheel. The rotation of the thumb wheel 48 in turn rotates cog wheel 46 and marking wheel 42. The jeweler continues to rotate thumb wheel 48 until the desired symbol is positioned adjacent the indicator marking on shaft 44. With his other hand the jeweler places the ring over jaw 28 and positions it directly opposite marking wheel 42. He then squeezes handle portions 14 and 20 until the movement of the jaw element is terminated by the presence of screw 40. The handles are then released and the ring removed with the symbol stamped into its shank.

The second preferred embodiment of the present invention is essentially the same device as previously described with the exception that a plurality of marking wheels are provided in tandem on jaw 28. In FIG. 2 this embodiment is shown with three marking wheels 64, 66, and 68. Each of these marking wheels is in communication with at least one of the secondary cog wheels 54 and 56. The first marking wheel 68 is in communication with the principal cog wheel 70. The principal cog wheel 70 is also in communication with thumb wheel 72 such that when thumb wheel 72 is rotated all of the cog wheels and marking wheels are rotated simultaneously.

Furthermore, each of the marking wheels is provided with a bearing ball 43 adjacent its periphery. Each of these balls is spring loaded in an indent (not shown) in order to induce proper indexing and positioning of the marking wheel.

The operation of this embodiment of the device is essentially the same as that previously described for the first embodiment except that the jeweler must first choose the marking wheel which contains the symbol which he desires to stamp into the ring. Once the appropriate wheel is chosen, the thumb wheel 72 is rotated until the desired symbol on the appropriate marking wheel is in position for stamping. The jeweler than inserts the ring adjacent this wheel and squeeze the handle members together to stamp the symbol on the ring. The other marking wheels are not used at all in the stamping process. Only the wheel which contains the appropriate symbol is utilized. The advantage of this type of configuration is merely to provide the jeweler with a greater variety of symbols to choose from.

The third preferred embodiment of the present invention is shown in FIGS. 3 and 4. As can be seen from FIG. 3, this embodiment is essentially the same mechanism as those previously described except for the configuration of the marking wheels.

As can be seen in FIG. 4, which is an exploded view of the marking wheels and associated mechanism, this embodiment is substantially more complicated than the previous two. In this embodiment, jaw element 28 is replaced by a jaw element having two separate portions designated generally as 74 and 76. An opening portion 78 is maintained within the interior of the jaw element for the proper location of the various gears and wheels necessary for the functioning of this device. Four separate marking wheels 80, 82, 84 and 86 are provided within opening 78. These wheels are all rotatably mounted on axle 88, which is in turn rotatably mounted within the jaw element. Cog wheel 90 is fixably mounted on half-axle 92. Cog wheel 94 is rotatably mounted on half-axle 92 and cog wheels 90 and 94 are positioned within opening 78 in the jaw element. In addition, the teeth of cog wheel 90 are meshed with the teeth of marking wheel 84 and the teeth of cog wheel 94 are meshed with the teeth of marking wheel 86. Half-axle 92 is affixed to thumb wheel 96 which is located on the exterior of side 74 of the jaw element. The rotation of thumb wheel 96 will rotate cog wheel 90 and thus marking wheel 84, but will not disturb cog wheel 94 nor marking wheel 86. Cog wheel 98 is fixably mounted to half-axle 100 within the opening 78 of the jaw element. Thumb wheel 102 is fixably mounted to the opposite end of half-axle 100 on the exterior of the jaw element. The rotation of thumb wheel 102 will rotate cog wheel 98, whose teeth are meshed with the teeth of cog wheel 94. The rotation of cog wheel 98 will, therefore, rotate cog wheel 94 and thus marking wheel 86. However, this rotation will not disturb the position of marking wheel 84.

The mechanism on the other side of the jaw element works in essentially the same way. Cog wheel 104 is fixably mounted to half-axle 106 upon which cog wheel 108 is rotatably mounted. Cog wheel 104 has its teeth meshed with the teeth of marking wheel 82 and cog wheel 108 has its teeth meshed with the teeth of marking wheel 80. Cog wheels 104 and 108 are positioned within opening 78 in the jaw element and thumb wheel 110 is fixably mounted to the end of half-axle 106 external to the jaw element. Cog wheel 112 is fixably mounted to half-axle 114 within the opening 78 in the jaw element. Thumb wheel 116 is fixably mounted to the other end of half-axle 114 externally to the jaw element. Cog wheel 112 has its teeth meshed with the teeth of cog wheel 108. The rotation of thumb wheel 110 will rotate cog wheel 104 and thus marking wheel 82. All other wheels will remain undisturbed. The rotation of thumb wheel 116 will rotate cog wheel 112 which in turn rotates cog wheel 108 to rotate marking wheel 80. Thus, each of the marking wheels can be selectively positioned independently of all of the other wheels.

Shaft 118 is provided within half-axle 92 and 106 to prevent any axial bending while permitting independent rotation of the half-axles. Shaft 120 is provided within half-axles 100 and 114 for a similar purpose.

Axle 88 is provided with two grooves 122 and 124 around half of its surface. These grooves are positioned immediately adjacent marking wheels 86 and 80 respectively. Axle 88 is rotatable between a first position and a second position with respect to the jaw element. In the first position the non-grooved surface of the axle is positioned towards the opposite jaw element. This position would be used for stamping an object which has little or no curvature. However, for a ring in which the curvature is fairly large due to its small size, the axle is turned to the second position and marking wheels 86 and 80 slide into grooves 124 and 122 respectively. This positioning tends to accommodate the curvature of the ring and allows for a stamping in which the symbols are more nearly stamped to a uniform depth. An arrow is provided on the outer surface of axle 88 to indicate its orientation.

Member 125 is fixably mounted to the underside of the jaw element. This member has four individual flexible prongs protruding from it adjacent to the marking wheels, each prong in contact with one of the cog wheels. Since the prongs are flexible, they act as a spring in order to allow rotation of each of the marking wheels a tooth at a time, and also tend to align the teeth on the various marking wheels which are in stamping position. This provides a stamp with the digits automatically aligned with each other.

FIG. 5 shows an alternate means of accomplishing this same purpose. A metallic axle 126 is surrounded by another axle 128 which is manufactured of deformable but uncompressable material, such as urethane. The marking wheels are then placed around the urethane axle and when the symbols are stamped on the ring the marking wheels will adjust to the curvature of the inside of the ring shank and the digits will be stamped in substantially equal depth.

FIG. 6 depicts still another embodiment in which the axle is made of a metallic, preferably steel shank 200 having a half cylindrical, hollow section 202 intermediate two end sections 204,206. A deformable insert 208, preferably urethane, which is basically deformable but incompressible, is mounted in the cylindrical section 202. It is this urethane insert that the marking wheels 80–86, or at least marking wheels 82,84, are placed on. The urethane insert allows the marking wheels to adjust precisely to the curvature of the jewelry or ring to be stamped, and tends to insure even pressure on all marking wheels to prevent any one marking wheel from cutting deeper into the surface of the ring than others.

It is to be understood that the rectangular end of axle 88 as shown in FIG. 4 can also be placed on one of the end sections 204,206.

As shown in FIG. 6C, the cylindrical section 202 is recessed over its outer surface 210 to accommodate the marking wheels.

Furthermore, this adjustable axle is also utilized when imprinting is to be done on the outer surface of a ring. Because of its adjustability it can accommodate either concave or convex curvature. In addition, it will serve to compensate for slight manufacture variations in unevenness of the teeth of the marking wheels.

It is to be understood that modifications may be made which are not specifically described herein, but will be obvious to those skilled in the art. It is intended to cover all such modifications which fall within the spirit and scope of the invention as defined in the appended claims.

What is claimed is:

1. A tool for stamping symbols on jewelry comprising: a pliers having a pair of handle members, said members moveable between a first open position and a second clamping position, a jaw element mounted on each of said handle members, a plurality of marking wheels in one of said jaw elements, an axle mounted on said one jaw element, said marking wheels being mounted on said axle, said axle comprising means for permitting the marking wheels to move vertically with respect to the axis of said axle and each other whereby the curvature of the jewelry is compensated for, a plurality of cog wheels in said one jaw element equal in number to the number of marking wheels, each of said cog wheels being in cooperating relationship with a different one of said marking wheels, and means for rotating said cog wheels individually to move selected ones of said marking wheels.

2. The tool according to claim 1 wherein said axle comprises a plurality of cam grooves cut into the surface thereof, a plurality of marking wheels equal in number to said grooves being carried in said grooves, said axle being rotatable to permit repositioning the marking wheels in said cam grooves to take account of the curvature of the surface to be stamped.

3. The tool according to claim 1 wherein said axle comprises a shaft, a urethane bushing on said shaft, said marking wheels being carried on said urethane bushing.

4. The tool according to claim 1 wherein said axle comprises a shaft having a pair of cylindrical end sections and a half cylindrical hollow section positioned between said end sections, a urethane insert in said half cylindrical hollow section on which said marking wheels are carried.

5. The tool according to claim 4 wherein said half cylindrical hollow section is recessed over its outer surface with respect to said end sections.

6. The tool according to claim 1, further comprising first, second, third and fourth cog wheels and first, second, third and fourth marking wheels, each of said cog wheels being in the shape of a gear, the first cog wheel being in communication with the second marking wheel and the second cog wheel being in communication with the third marking wheel, a first and a second half axle, each of said half axles being rotatably mounted in said jaw element, the first half axle being fixedly mounted to the first cog wheel and the second half axle being fixedly mounted to the second cog wheel, a third cog wheel and a fourth cog wheel, each of said cog wheels being in the shape of a gear, the third cog wheel being in communication with the first marking wheel and rotatably mounted on the first half axle, the fourth cog wheel being in communication with the fourth marking wheel and rotatably mounted on the second half axle, a third half axle and a fourth half axle, each of said half axles being rotatably mounted in said jaw element, a first gear and a second gear, said first gear being fixedly mounted on said third half axle and in communication with said third cog wheel and said second gear being fixedly mounted on said fourth half axle and in communication with said fourth cog wheel, a first thumb wheel, a second thumb wheel, a third thumb wheel and a fourth indexing wheel fixedly mounted to the first half axle, second half axle, third half axle and fourth half axle respectively such that when any one of the thumb wheels are rotated the corresponding marking wheel is rotated without moving the other marking wheels.

7. The device according to claim 6 wherein each thumb wheel has printed on it symbols corresponding in position to those engraved on the teeth of the marking wheel which it controls to enable selective positioning of the desired symbols for stamping.

8. The device according to claim 6, further comprising a first shaft and a second shaft, said first shaft being positioned within the first and second half axles and the second shaft being positioned within the third and fourth half axles respectively to prevent misalignment of the respective sets of half axles.

9. The device according to claim 5 further comprising means for limiting the rotation of each of said marking wheels to an angle rotation equivalent to one tooth at a time.

10. The device according to claim 9 wherein said rotation limiting means comprises a member having four flexible prongs, each of said prongs being in communication with the teeth of one of said cog wheels.

11. The device according to claim 6 further comprising means for maintaining said jaws in a substantially parallel relationship at all times.

12. The device according to claim 11 wherein said maintaining means comprises:

two pins, each of said pins being located on the tip of the forward portion of one of the handle members, each of said pins passing through a hole in one of the jaw elements such that each jaw element is rotatable with respect to the adjacent handle member as the handle members move between the first and second positions, two shafts, each of said shafts being located on the handle portion of one handle member, and two slots, each of said slots being located on one of the jaw elements such that one of the shafts can slide within each of the slots such that said jaw elements are retained in a parallel relationship regardless of the position of the handle member.

13. The device according to claim 6 further comprising adjustable means for limiting the movement of the handle members towards the second position such that the distance between the jaws is maintained in order to insure stamping to the desired depth.

* * * * *